US006166529A

United States Patent [19]

Ikeuchi et al.

[11] Patent Number: 6,166,529

[45] Date of Patent: Dec. 26, 2000

[54] VOLTAGE-CURRENT CONVERSION CIRCUIT

[75] Inventors: Akira Ikeuchi; Naoshi Tokuda, both of Atsugi, Japan

[73] Assignee: Mitsumi Electric Co., Ltd., Tokyo, Japan

[21] Appl. No.: 09/511,935

[22] Filed: Feb. 24, 2000

[30] Foreign Application Priority Data

Mar. 10, 1999 [JP] Japan ..... 11-063913

[51] Int. Cl.[7] ..... G05F 3/16

[52] U.S. Cl. ..... 323/315

[58] Field of Search ..... 323/312, 314, 323/315, 316; 330/257, 288; 327/534, 535, 538

[56] References Cited

U.S. PATENT DOCUMENTS 4,338,527 7/1982 Nagano ..... 307/494
4,560,920 12/1985 Okanobu ..... 323/315
5,519,309 5/1996 Smith ..... 323/316
5,629,614 5/1997 Choe et al. ..... 323/315
5,994,887 11/1999 Tokuda ..... 323/313

*Primary Examiner*—Matthew Nguyen
*Attorney, Agent, or Firm*—Ladas & Parry

[57] ABSTRACT

A voltage-current conversion circuit outputting a current corresponding to a difference between a first input voltage and a second input voltage, the voltage-current conversion circuit having a first current-mirror circuit supplied with the first input voltage as a power source and comprising at least one pair of transistors, a second current-mirror circuit supplied with the second input voltage as a power source and comprising at least one pair of transistors, a resistor connected between one of the pair of transistors of the first current-mirror circuit and one of the transistors of the second current-mirror circuit, and a third current-mirror circuit having a current source transistor supplying current to one of the pair of transistors of the first current-mirror circuit and another current source transistor supplying current to one of the pair of transistors of the second current-mirror circuit, a current output terminal being connected to one of the current source transistors.

2 Claims, 2 Drawing Sheets

VOLTAGE-CURRENT CONVERSION CIRCUIT

BACKGROUND OF THE INVENTION

1. Field of the Invention

The present invention relates generally to a voltage-current conversion circuit, and more particularly, a voltage-current conversion circuit outputting a current corresponding to a difference in input voltages applied to a pair of transistors forming a differential circuit.

2. Description of the Related Art

Conventionally, as a voltage-current conversion circuit adapted for a variable low-pass filter, electronic volume and the like, a circuit like that shown in FIG. 1 is known. In FIG. 1, input voltages Vin1, Vin2 are applied to a pair of input terminals 10, 11. Each of the input terminals 10, 11 is connected to the bases of npn transistors Q1, Q2, respectively, the npn transistors Q1, Q2 forming a differential circuit. The collectors of transistors Q1, Q2 are connected to the collectors of transistors Q3, Q4. Transistors Q3, Q4 form a current-mirror circuit, their bases being connected to each other and jointly connected to the collector of Q3 and their respective emitters being connected to a power source Vcc.

An output terminal 14 outputting a current Iout is connected to the collector of the transistor Q4. The emitters of transistors Q1, Q2 are connected both to the two ends of the resistor Rg as well as to a constant current source 12, 13 generating constant currents I, I' (I'≈I).

It should be noted that when an input voltage differential dV (=Vin1 minus Vin2) is applied between the input terminals 10, 11 a current Ig (=dV/Rg) corresponding to the voltage dV flows to the resistor Rg, the output current Iout being generated based on the current Ig.

A requirement of the conventional circuit described above is that the input voltages Vin1, Vin2 be lower than the power source voltage Vcc. If this requirement is not met the circuit does not operate properly. As a result, the size of the input voltages Vin1, Vin2 is limited and hence the range of applications of the circuit is limited as well.

SUMMARY OF THE INVENTION

Accordingly, it is a general object of the present invention to provide an improved and useful voltage-current conversion circuit in which the disadvantages described above are eliminated.

A more specific object of the present invention is to provide an improved and useful voltage-current conversion circuit not restricted by the requirement that the input voltages be lower than the power source voltage and hence capable of an expanded range of applications.

The above-described object of the present invention is achieved by a voltage-current conversion circuit outputting a current corresponding to a difference between a first input voltage and a second input voltage, the voltage-current conversion circuit comprising:

- a first current-mirror circuit supplied with the first input voltage as a power source and comprising at least one pair of transistors;
- a second current-mirror circuit supplied with the second input voltage as a power source and comprising at least one pair of transistors;
- a resistor connected between one of the pair of transistors of the first current-mirror circuit and one of the transistors of the second current-mirror circuit; and

- a third current-mirror circuit comprising:
  - a current source transistor supplying current to one of the pair of transistors of the first current-mirror circuit; and
  - another current source transistor supplying current to one of the pair of transistors of the second current-mirror circuit,
  - a current output terminal being connected to one of the current source transistors.

According to the invention described above, the voltage-current conversion circuit not restricted by the requirement that the input voltages be lower than the power source voltage because the first and second input voltages are supplied to the first and second current-mirror circuits as power sources. As a result, the voltage-current conversion circuit is capable of an expanded range of applications.

Additionally, the above-described object of the present invention is also achieved by the voltage-current conversion circuit as described above, wherein the first current-mirror circuit and the second current-mirror circuit are Wilson-type current-mirror circuits.

According to the invention described above, the identity of the current flowing to the pairs of transistors forming the first and second current-mirror circuits increases.

Other objects, features and advantages of the present invention will become more apparent from the following detailed description when read in conjunction with the accompanying drawings.

DESCRIPTION OF THE PREFERRED EMBODIMENTS

A description will now be given of a preferred embodiment of a voltage-current conversion circuit according to the present invention, with reference to the accompanying drawings.

Figure 1:
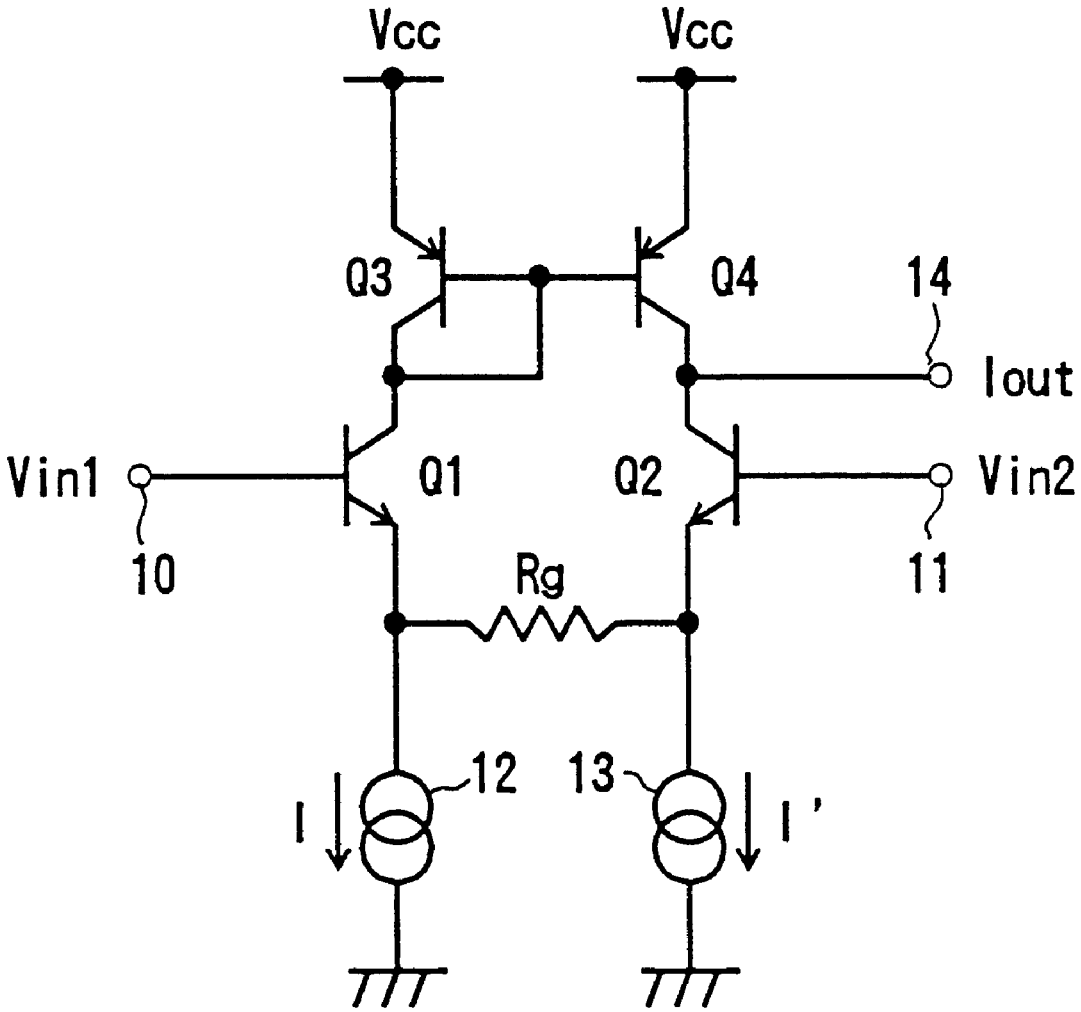
FIG. 1 PRIOR ART
FIG. 1 shows a conventional voltage-current conversion-circuit.
Figure 2:
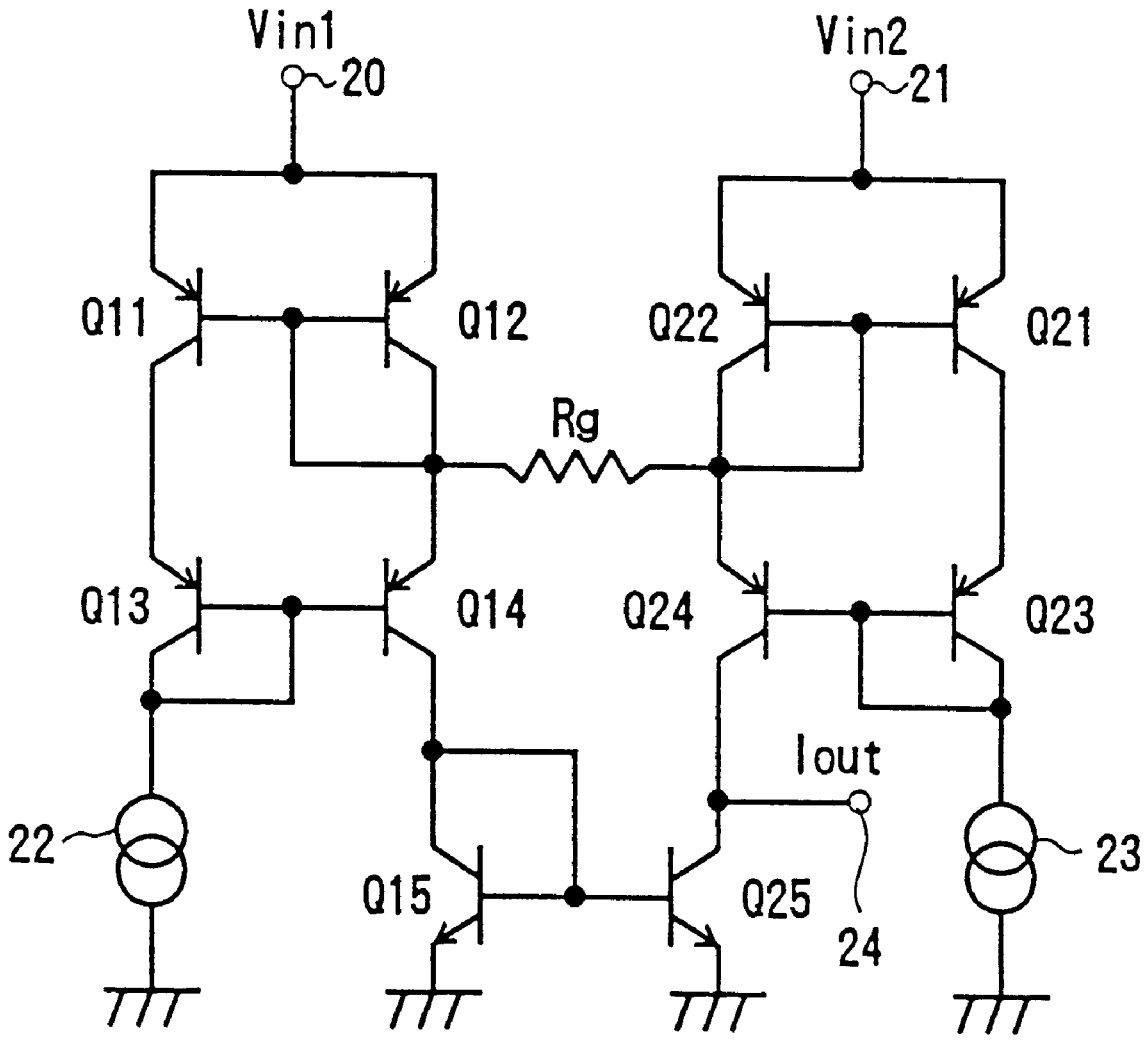
FIG. 2 shows an embodiment of a voltage-current conversion circuit according to the present invention.

FIG. 2 shows an embodiment of a voltage-current conversion circuit according to the present invention. As shown in the diagram, input voltages Vin1, Vin2 are applied to a pair of input terminals 20, 21, respectively. Input terminal 20 is connected to the emitters of pnp transistors Q11, Q12 which together form a current mirror circuit. Input terminal 21 is connected to the emitters of pnp transistors Q21, Q22 which together form a current-mirror circuit.

The bases of transistors Q11, Q12 are connected to each other and jointly connected to the collector of transistor Q12. The collectors of transistors Q11, Q12 are connected to the emitters of pnp transistors Q13, Q14. The bases of transistors Q13, Q14 are connected to each other and jointly connected to the collector of transistor Q13 to form a current-mirror circuit. Transistors Q11, Q12, together with transistors Q13, Q14, form a Wilson-type current-mirror circuit. The collector of transistor Q13 is grounded via a constant current source 22 that generates a constant current I. The collector of transistor Q14 is connected to the collector of npn transistor Q15.

At the same time, the bases of transistors Q21, Q22 are connected to each other and jointly connected to the collector of transistor Q22. The collectors of transistors Q21, Q22 are connected to the emitters of pnp transistors Q23, Q24. The bases of transistors Q23, Q24 are collected to each other and jointly connected to the collector of transistor Q23 to form a current-mirror circuit. Transistors Q21, Q22, together with transistors Q23, Q24, form a Wilson-type current-mirror circuit. The collector of transistor Q23 is grounded via a constant current source 23 that generates a constant current I.

A resistor Rg is connected between the collector of transistor Q12 and the collector of transistor Q22. Additionally, the base of transistor Q15 is connected to the collector of transistor Q15, the base of transistor Q15 is connected to the base of transistor Q25 and the emitters of transistors Q15, Q25 are grounded to form a current-mirror circuit. Additionally, an output terminal 24 is connected to the collector of transistor Q25. Power for the entire circuit is supplied from input voltages Vin1, Vin2.

A description will now be given of the operation of the transistors Q11, Q12, Q13, Q14 that together form the Wilson-type current-mirror circuit. Transistors Q13, Q14 act to correct the base current of transistors Q11, Q12 and eliminate the early effect of transistors Q11, Q12, thus increasing the identity of the emitter current of transistors Q11, Q12.

That is, if a forward voltage drop between the bases and emitters of transistors Q13, Q14 is Vbe13, Vbe14 (Vbe13=Vbe14), then the electric potential at the collector of transistor Q12 can be expressed as −Vbe14+Vbe13=electric potential at the collector of transistor Q11, and the electric potentials at the collectors of transistors Q11, Q12 become identical and, as a result, the respective emitter currents of transistors Q11, Q12 become identical.

Similarly, if a forward voltage drop between the bases and emitters of transistors Q23, Q24 is Vbe23, Vbe24 (Vbe23=Vbe24), then the electric potential at the collector of transistor Q22 can be expressed as −Vbe24+Vbe23=electric potential at the collector of transistor Q21, and the electric potentials at the collectors of transistors Q21, Q22 become identical and, as a result, the respective emitter currents of transistors Q21, Q22 become identical.

Additionally, constant current sources 22, 23 generate the same constant current I, transistors Q15, Q25 form a current-mirror circuit and the respective emitter currents are approximately identical, that is, equal to I, so the emitter currents of transistors Q11, Q12, Q21, Q22 become identical.

If input voltages Vin1, Vin2 are identical, and if a forward voltage drop between the bases and emitters of transistors Q12, Q21 is Vbe12, Vbe22 (Vbe12=Vbe22), then at the collectors of transistors Q12, Q22

$$Vin1-Vbe12=Vin2-Vbe22$$

and no current flows to the resistor Rg.

For example, assuming an input voltage Vin2 rises such that Vin1<Vin2, then Vin1−Vbe12<Vin2−Vbe22 and a current Ir [Ir=(Vin2−Vin1)] flows from transistor Q22 toward transistor Q12 to resistor Rg. As a result, the transistor Q24 collector current decreases and a current Iout corresponding to the amount of that decrease, that is, a current of the same strength as current Ir, flows to the output terminal 24 from the subsequent circuitry.

Conversely, if the input voltage Vin1 rises so that Vin1>Vin2, then Vin1−Vbe12>Vin2−Vbe22 and a current Ir' [Ir'=(Vin1−Vin2)/Rg] flows from transistor Q12 toward transistor Q22 to resistor Rg. As a result, the transistor Q24 collector current increases and a current Iout corresponding to the amount of that increase, that is, a current of the same strength as current Ir', flows to the subsequent circuitry.

As described above, a current Iout corresponding to the difference between input voltages Vin1 and Vin2 (Vin1−Vin2) is output from output terminal 24.

Additionally, the power for the circuit is supplied from the input voltages Vin1, Vin2 and no conditions restrict input voltages Vin1, Vin2, so the circuit can be used in an expanded range of applications as compared to the conventional art.

It should be noted that in the above description the pnp transistors and npn transistors may be replaced with npn transistors and pnp transistors, respectively, and moreover a negative power source may be used instead of the ground level so as to accommodate input voltages Vin1, Vin2 less than that of the ground level.

Further, the circuit according to the embodiment described above can also be used in conjunction with a circuit in which the pnp transistors and npn transistors are switched as described above and the input terminal switched so as to be connected to one or the other circuit depending on whether the input voltages Vin1, Vin2 are greater than ground level or less than ground level.

As will be appreciated by those skilled in the art, transistors Q11, Q12, Q13, Q14 correspond to the first current-mirror circuit claimed hereinbelow, transistors Q21, Q22, Q23, Q24 correspond to the second current-mirror circuit claimed hereinbelow and transistors Q15, Q25 correspond to the third current-mirror circuit as claimed hereinbelow.

The above description is provided in order to enable any person skilled in the art to make and use the invention and sets forth the best mode contemplated by the inventors of carrying out the invention.

The present invention is not limited to the specifically disclosed embodiments and variations, and modifications may be made without departing from the scope and spirit of the present invention.

The present application is based on Japanese Priority Application No. 11-63913, filed on Mar. 10, 1999, the entire contents of which are hereby incorporated by reference.

What is claimed is:

1. A voltage-current conversion circuit outputting a current corresponding to a difference between a first input voltage and a second input voltage, the voltage-current conversion circuit comprising:

a first current-mirror circuit supplied with the first input voltage as a power source and comprising at least one pair of transistors;

a second current-mirror circuit supplied with the second input voltage as a power source and comprising at least one pair of transistors;

a resistor connected between one of the pair of transistors of the first current-mirror circuit and one of the transistors of the second current-mirror circuit; and a third current-mirror circuit comprising:

a current source transistor supplying current to one of the pair of transistors of the first current-mirror circuit; and another current source transistor supplying current to one of the pair of transistors of the second current-mirror circuit, a current output terminal being connected to one of the current source transistors.

2. The voltage-current conversion circuit as claimed in claim 1, wherein the first current-mirror circuit and the second current-mirror circuit are Wilson-type current-mirror circuits.

* * * * *